United States Patent [19]

Bimpson

[11] Patent Number: 4,472,225

[45] Date of Patent: Sep. 18, 1984

[54] INFLATABLE TUBE

[75] Inventor: Malcolm Bimpson, Atherton, England

[73] Assignee: Dunlop Limited, London, England

[21] Appl. No.: 204,808

[22] Filed: Nov. 7, 1980

Related U.S. Application Data

[63] Continuation of Ser. No. 99,095, Nov. 10, 1979, abandoned.

[30] Foreign Application Priority Data

Dec. 9, 1978 [GB] United Kingdom ..... 47876/78

[51] Int. Cl.[3] ..... A63B 39/00

[52] U.S. Cl. ..... 156/198; 156/218; 156/227

[58] Field of Search ..... 156/218, 203–204, 156/226, 227, 198; 9/2 A, 11 A

[56] References Cited

U.S. PATENT DOCUMENTS 2,456,086 12/1948 Schwall ..... 9/2 A 3,919,027 11/1975 Jones ..... 156/218 X

FOREIGN PATENT DOCUMENTS 2644005 5/1977 Fed. Rep. of Germany ..... 9/2 A

*Primary Examiner*—David A. Simmons

*Attorney, Agent, or Firm*—Stevens, Davis, Miller & Mosher

[57] ABSTRACT

The invention relates to inflatable tubes such as buoyancy tubes for inflatable liferafts and is aimed to provide tubes with bends in them that can be formed with a considerable reduction in the number of cutting and joining operations conventionally required and with a corresponding reduction in numbers of seams and hence sources of leakage. The invention provides a method of making such tube by overlapping and joining the longitudinal edges (231) of a suitable sheet material (230) to make a flattened tube (230A), marking on said tube a fold line (234) corresponding to the desired bend position, marking corresponding areas (237A, 237B) one on each side of the fold line, folding about the fold line to bring and join together these areas and then sealing the ends (232A, 232B) of the tube. By making a number of bends the ends of the tube can be sealed to each other, thereby making an endless tube of polygonal plan form.

12 Claims, 15 Drawing Figures

FIG. 6
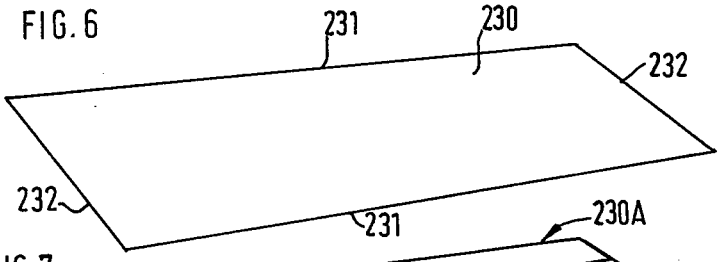
FIG. 7
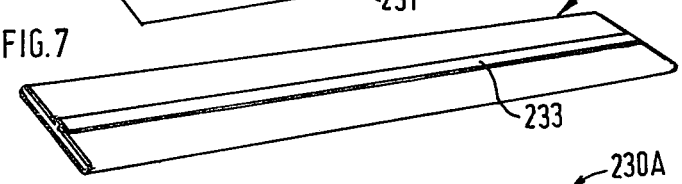
FIG. 8
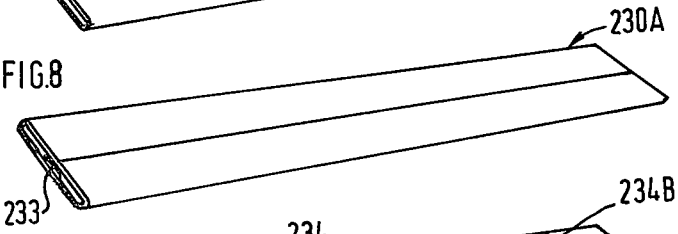
FIG. 9
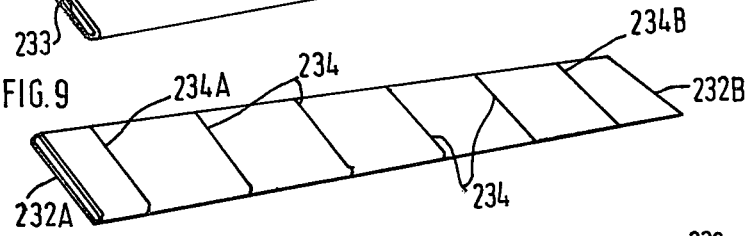
FIG. 10
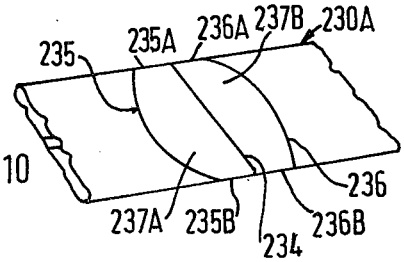
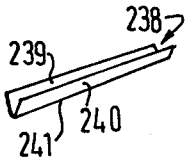
FIG. 11

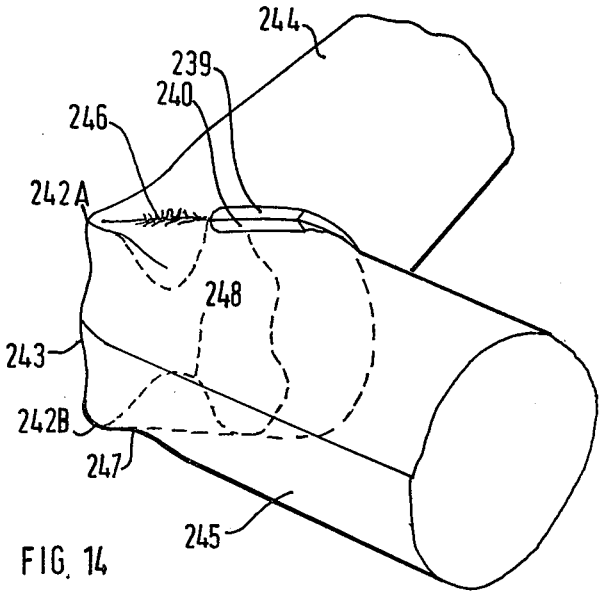
FIG. 14
FIG. 15
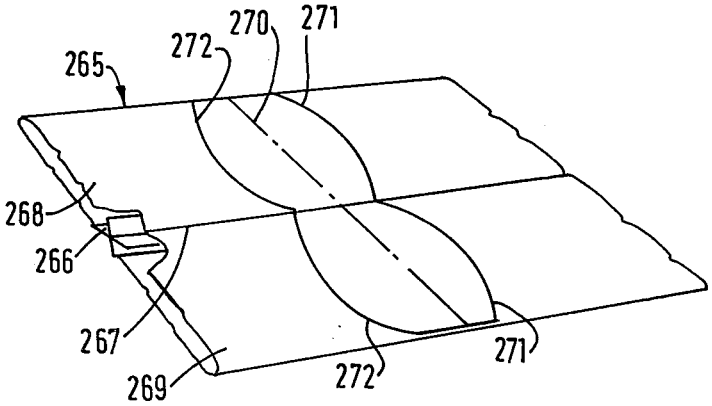

INFLATABLE TUBE

This is a continuation of application Ser. No. 099,095 filed Nov. 10, 1979, now abandoned.

This invention relates to inflatable tubes, i.e. hollow tubes of, for example, polymer-coated fabric material, that are suitable for use, for example, as buoyancy tubes for inflatable liferafts.

Inflatable liferafts are usually made having one or more buoyancy tubes around their perimeter, the tube(s) supporting the raft in its floating condition. Conventional liferafts have a buoyancy tube made in a number of separate lengths, depending on the overall length of the perimeter of the raft, and these separate lengths of tube have to be sealingly joined together to form a leak-proof, complete buoyancy tube. The complete tube will normally be polygonal in shape, e.g. pentagonal or hexagonal, or it may have a larger number of sides to approach more nearly circular form. Clearly the formation and joining together of separate lengths of tube is a time-consuming and laborious operation and each joint is a potential source of leakage. Hence the possibility of using a single length of buoyancy tube—which is bent or folded at appropriate points, corresponding to the junction of adjacent sides of the polygon, until its two ends meet and can be joined together—has obvious advantages. (Such a tube will herein, for convenience, be called an "endless tube"). However, despite various proposals, a practical means of achieving this has not, so far as we are aware, been previously proposed. The present invention provides such a practical means.

One specific prior proposal which is aimed at reducing the laborious cutting and joining operation is disclosed in U.S. Pat. No. 2,456,086. That specification teaches a method of making an endless inflatable tube from a single strip of rubberised fabric by a means involving the formation of "tucks", i.e. folds, which are spaced along one side of the length of the fabric, thereby shortening it, and joining together the longitudinal edges and joining together the end edges of the strip with the tucks inside. Although this method does result in the elimination of many of the conventional cutting and joining operations, and thereby results in a product with fewer joints that might be a source of leakage, it does introduce a further, practical difficulty. This arises from the fact that a series of tucks or folds are made in a flat sheet of the fabric and the longitudinal edges of the fabric then have to be joined together to convert the sheet into tubular form. It will be appreciated that it is not easy to make a leak-proof and tidy longitudinal join from a length of sheet which has a number of folds in it of the type shown in FIG. 10 of U.S. Pat. No. 2,456,086. Furthermore, one potential advantage of using a single piece of fabric to form an endless tube is the possibility it introduces of mechanisation of at least part of the process. However, the difficulty of making the longitudinal join in the method of this U.S. patent makes mechanisation of that step difficult.

The present invention aims to provide a means of making endless tube without the aforementioned difficulty of longitudinal joining and to provide thereby a method that is more amenable to mechanisation.

Accordingly the invention provides a method of making a length of inflatable tube with a bend in it, which includes the steps of overlapping and joining the longitudinal edges of a suitable sheet of material to form a flattened tube, marking on one surface of the flattened tube a fold line corresponding to the desired position of the bend, marking one on each side of the fold line, two areas of the fabric that are to be pressed together to form the bend folding the flattened tube so that said two areas contact each other, joining said two areas together and sealing the ends of the tube. The fold line will usually be made substantially normal to the longitudinal direction of the flattened tube. It will also normally be found convenient to turn the flattened tube inside out before applying the markings. The longitudinal joint, which is usually covered by a length of tape, will then be inside.

The invention also provides as a novel product an inflatable tube having a bend or corner when in inflated form, the bend being formed by the method described in the immediately preceding paragraph.

It is not necessary to join the two areas, which are folded together about the fold line, over the whole of their respective areas and in fact, as is explained further below, joining in the region of the perimeter only of those areas may be advantageous.

The number of fold lines and hence the number of bends or corners may be varied to suit the particular requirement. Where, as will often be the case, the ends of the tube are sealed by joining them together to form an endless tube after the bends have been provided, conventional methods of joining may be used.

The invention is suitable for use with any sheet materials used in the manufacture of inflatable watercraft and other flexible air-holding products. Hence the sheet material used may be, for example, polymer-coated fabric or thermoplastic material. The latter may be reinforced or unreinforced depending on the nature of the desired product.

Where thermoplastic sheet material is used, the two areas adjacent the fold line may conveniently be joined to each other by a welding technique, although adhesive could be used if desired. The welding may be carried out by any convenient means, including heat—, H.F.—or R.F.—welding techniques. It will also be appreciated that it may be necessary, where a welding technique is used, to position suitable barrier material between the layers of sheet material, i.e. inside the flattened tube, to prevent their joining together during the welding step. Such barrier material is well known in the art.

The welding apparatus will have electrodes of the required shape and size to correspond to the areas marked on the sheet material. In fact these two features—marking and welding—could be combined so that a separate marking stage is unnecessary, this being carried out automatically by the positioning of the welding apparatus relative to the sheet and this then being combined with a folding mechanism.

If a particular product made by the welding technique requires additional strengthening at the bend or corner, this can be provided by the use of a reinforcing tape, which may for example be adhered in position.

The use of polymer-coated fabric to make the tube is in fact a preferred embodiment and the invention will therefore be further described with reference particularly to that embodiment. The preferred means of joining together the two areas adjacent the fold line in this embodiment is as follows. One arm of a folded tape or hinge is adhered around the perimeter of the marked area on a first side of the fold line, the open side of the hinge tape lying away from the fold line. Adhesive is applied to the exposed face of the unadhered arm of the hinge tape and the fabric is bent about the fold line until the perimeter of the marked area on the second side of the fold line contacts and is adhered to the adhesive-coated surface of the hinge tape on the first side.

The area marked on either side of the fold line is preferably marked with the use of a suitably-shaped and dimensioned template and a preferred method for determining the template dimensions will be described in more detail below.

It may be found advantageous to apply adhesive over some of the area inside that marked out by the template in addition to that applied to the hinge tape. For example an adhesive coating on both sides of the fold line and extending inside the marked perimeter for say 3–5 cms will give a larger area of bonded fabric inside the fold and will help to strengthen the bond made by the hinge tape. However, it may be advantageous to leave a reasonable area marked out uncoated by adhesive so as to avoid excessive stiffening that could result from bonding together too large an area of the fabric.

The hinged joining tapes are conveniently of the same material as that used for the tube itself but this may not be essential.

As indicated above, the method of the present invention has advantages over that disclosed in U.S. Pat. No. 2,456,086 in that it eliminates the difficulty of making the longitudinal seam of the tube while retaining the advantages of reduction in cutting and joining compared to conventionally-used methods. Moreover, there is also a significant visual difference between the products of U.S. Pat. No. 2,456,086 and the present invention. Referring to FIG. 7 of that U.S. patent, it will be seen that curves 32, 33; 34, 35; 36, 37; 38, 39 and 40, 41 define areas adjacent fold lines 42, which areas correspond to the amount of the sheet material that has to be "lost" inside each fold or tuck in order for the desired bends or corners to be formed. However, in the method of the present invention, the areas adjacent the fold lines are only marked in effect on one half of the area of the sheet material since the sheet has been folded and joined longitudinally into a flattened tube and the marked areas are made on one face of that flattened tube. Hence the present invention does not automatically provide a means of "losing" all the sheet material that apparently requires to be lost inside each fold. Nevertheless, and perhaps rather surprisingly, the invention has been found to provide a very satisfactory product in which the sheet material which cannot be "lost" appears as protuberances or "ears" on the outside surface of the tube. The ears have been found to have no deleterious effect on the product and in fact give it a quite distinctive appearance.

Various embodiments of the invention will now be further described with reference to the accompanying drawings in which:

FIGS. 6 to 14 illustrate the manufacture of an inflatable tube with a bend or corner, in which:

FIG. 6 is a perspective view of a sheet of polymer-coated fabric;

FIG. 7 is a similar view of a flattened tube formed from the sheet of FIG. 6;

FIG. 8 is a similar view of the tube of FIG. 7 but turned inside out;

FIG. 9 shows the tube of FIG. 8 with fold lines marked on it;

FIG. 10 shows a portion of the tube of FIG. 9 with the mirror image areas marked one on each side of a fold line;

FIG. 11 is a perspective view of a portion of a length of hinge tape;

FIG. 12 shows the hinge tape applied to the tube of FIG. 10;

FIG. 13 shows the tube of FIG. 12 folded over to adhere together the desired area;

FIG. 14 shows a portion of the finished inflated tube;

FIG. 15 is a perspective view of a portion of flattened tubular sheet material illustrating a stage of a further embodiment of the invention.

Figure 1:
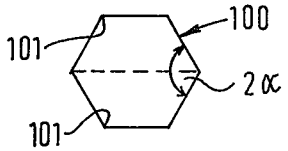
FIGS. 1 to 5 are diagrammatic illustrations of a preferred means of calculating the size and shape of a suitable template.

FIG. 1 is a representation of a plan view of six-sided inflatable boat 100. The boat therefore has six-bends or corners 101, each of which has an internal angle $2\alpha$ equal to approximately 120°. For this example therefore $\alpha=60°$.

Figure 2:
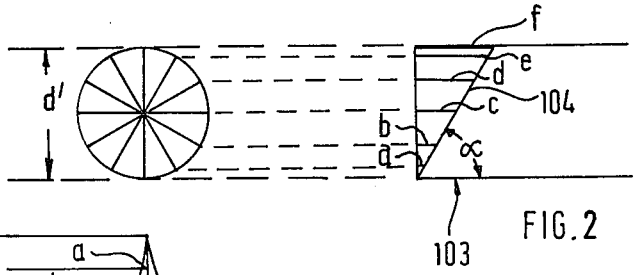

FIG. 2 shows a circle 102 of diameter d' where d' is the desired buoyancy tube diameter. The circle is divided by 12 radii into 12 equal segments, six of which on the right-hand side of the circle are shown transposed onto graph 103. Graph 103 has line 104 drawn at angle $\alpha$ i.e. 60° in this example. The distance from the vertical axis of the graph to line 104 is noted for each segment of the circle. These six distances are shown as a, b, c, d, e, and f.

Figure 3:
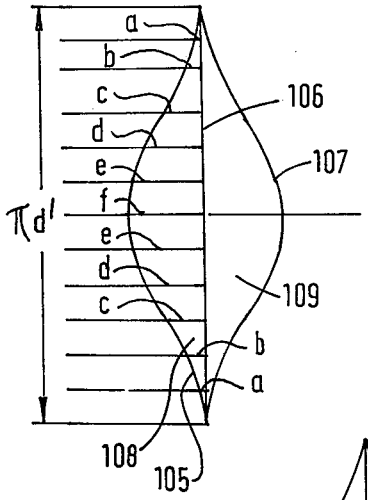
Figure 4:
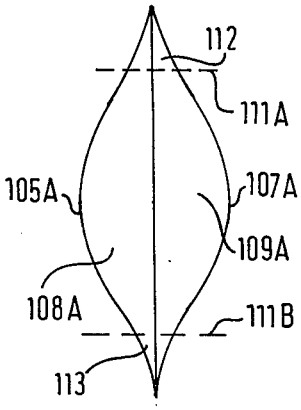

FIG. 3 shows the curve 105 derived by plotting these distances to one side of a vertical line 106 of length $\pi$ d'. Corresponding curve 107 can also be drawn to give two miror image areas 108 and 109, one on each side of line 106, which corresponds to the fold line. Curves 105 and 107 together define the shape of a template that could be used in the method of U.S. Pat. No. 2,456,086, i.e. where the areas are marked on the sheet material before it is made into tubular form. This template shape is then modified by truncation as shown in FIG. 4 to give a template shape suitable for use in the present invention. Lines 111A and 111B truncate the shape by cutting off the areas 112, 113 at the apices. The remaining mirror image areas 108A and 109A represent the amount of material that will be lost inside the fold or corner when the bend is made in the tube. In other words these mirror image areas represent portions which will be contained within a corner assembly of an eventual buoyancy tube. Thus a template is used having the shape defined by curves 105A and 105B and lines 111A and 111B. The remaining areas 112 and 113 at the two apices of the curves correspond to the sheet material that will form the "ears" or surplus pouches in the product.

The hinge tape, as is described in more detail below, will be adhered to a nascent buoyancy, tube along and on the outside of a line corresponding to one of curves 108A and 109A.

Figure 5:
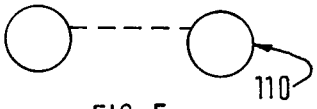

The calculation shown here has been based on a seam corresponding to the outside center line, i.e. as shown at 110 in FIG. 5. Lines 111A and 111B thus correspond approximately to the top and bottom centre lines of the eventual buoyancy tube.

It will be appreciated that the use of 12 radii is purely arbitrary and more or less may be used as desired. Obviously the more that are employed, the more 'plots' that are derived from the graph and the more accurate the curve will be. At the other extreme such a calculation may be dispensed with and the shape of the template derived by trial and error based on experience.

Also, in practice it may be found preferable to give a degree of curvature to lines 111A and 111B to give a better conformity to the bend area when inflated.

Referring now to FIGS. 6 to 14:

FIG. 6 shows a flat sheet 230 of a rubberised fabric suitable for the buoyancy tube of an inflatable liferaft. Its longer sides 231 are of the desired overall length of the finished buoyancy tube plus a small amount sufficient for an overlap joint to join together ends 232 to form the continuous tube. The ends of shorter sides 232 are of length sufficient to give the desired tube circumference, again plus a small amount sufficient for an overlap joint.

FIG. 7 shows the next stage in which ends 231 have been overlapped and adhered together to form a flattened tube 230A. This overlap joint has been covered by a tape 233 of similar rubberised fabric.

FIG. 8 shows the flattened tube 230A of FIG. 7 turned inside out so that the taped-over joint lies inside.

As a typical example, to make a six-sided inflatable boat (i.e. viewing the finished buoyancy tube in plan), a sheet a little over 24′ (7.32 meters) long and of width to give a tube diameter of 15 cms could be used. This then requires six bends (folds or corners) spaced 4′ (1.22 meters) intervals around the tube. The six fold lines 234 necessary to achieve this are shown marked on flattened tube 230A in FIG. 9. The end fold lines 234A and 234B are marked approximately 2′ (0.61 meter) from their respective ends 232A and 232B of the flattened tube and the remaining fold lines are spaced 4′ (1.22 meters) apart as shown.

FIG. 10 shows the next stage in which lines 235 and 236 have been marked by a suitable template (not shown), one on each side of a fold line 234. Curve lines 235 and 236 together with their respective top and bottom portions 235A, 235B and 236A, 236B of the flattened tube (which portions may if desired also be marked) define mirror image areas 237A and 237B one on each side of fold line 234. Areas 237A and 237B are in effect the areas of the flattened tube that have to be "lost" inside the bend or corner when the two perimeters of the marked areas are joined together to form the desired angle. In other words areas 237A and 237B represent unbonded portions which will be contained within the corner assembly of an eventual buoyancy tube.

FIG. 11 shows a length of folded hinge tape 238 which may be made of similar or the same polymer-coated fabric as the tube itself. The longitudinally-folded hinge has two longitudinal arms 239 and 240, which may each be, for example, ¼″ (6.35 mm) wide, the apex of the hinge extending longitudinally at 241.

Figure 12:
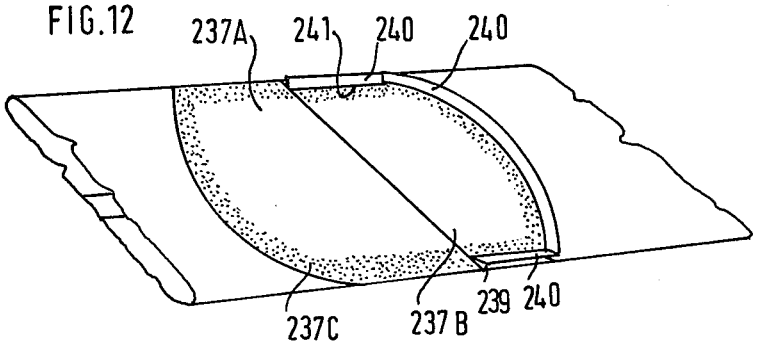

As shown in FIG. 12, a suitable length of hinge tape is now adhered by the outside of its arm 239, i.e. that surface on the ouside of the 'V' of the hinge, along the perimeter line 236 with hinge apex 241 adjacent area 237B and the arms 239 and 240 away from 237B. Similar lengths of hinge tape are similarly adhered along top and bottom portions 235A and 235B. (These three portions of hinge tape may be joined together if desired into a single piece, e.g. by slitting along the fold line at one end of one piece and inserting one end of the adjacent piece inside the slit and adhering the two together. Alternatively a piece of tape with radiused corners may be used).

Adhesive is then applied to the exposed surface of arm 240 of the hinge, i.e. that surface on the outside of the 'V' of the hinge, and to the corresponding portions of the arms of the hinges along perimeters 235A and 235B. Adhesive is also applied over the area 237C shown in FIG. 12 shaded inside the perimeters of areas 237A and 237B.

Figure 13:
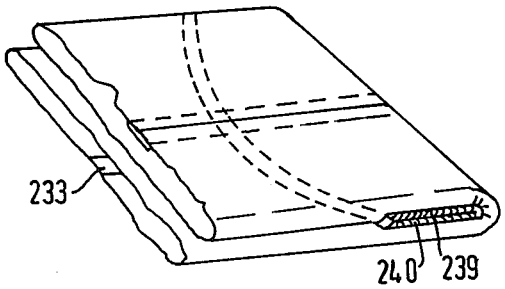

Flattened tube 230A is then folded until the adhesive-coated portion of area 237A contacts that of area 237B including the hinge. This stage is shown in FIG. 13.

FIG. 14 shows a portion of the product in inflated form, i.e. after all six bends have been formed and the two ends 232A and 232B of the tube have been overlapped and joined to form a continuous tube. The inside surfaces (i.e. inside the 'V' of the hinge tape) 239 and 240 are visible as the pressure of inflation will tend to open the hinge. One "ear" 242A has been formed at the top of the tube and another 242B at the bottom, both at the fold line. The two ears are separated by a nominally vertical outside corner 243. The surplus unbonded fabric corresponding to 237A and 237B is accommodated inside the volume between vertical outside corner and the hinge tape inside corner (and of course extending a little way along each arm 244 and 245 of the tube). The general configuration of the surplus fabric is somewhat as shown with labio form-like entrances 246 and 247 to pouch-like arrangements indicated by broken line 248. It will be appreciated that the actual configurations the surplus fabric will adopt inside the tube may vary widely and FIG. 14 is illustrative of a possible arrangement.

This invention is not limited to the production of single buoyancy tubes. Many inflatable rafts, boats and other inflatable structures comprise two or more tubes, one mounted on another. Such constructions can be built from tubes of the type described above. The present invention may, however, be used to advantage to simplify the manufacture of multiple tube constructions.

FIG. 15 illustrates a partially completed double buoyancy tube 265. It comprises a single sheet of rubberised fabric folded and joined along its longitudinal edges, in the manner previously described. A double hinge tape 266 is adhesively attached, as shown, along the centre line 267 of the folded and joined material. The previously single tube is converted into two contiguous tubes 268, 269 having only one longitudinal joint. Each of the pair of tubes may then be treated as described with reference to FIGS. 9 to 14 above to produce a double tube inflatable construction. They are shown in FIG. 15 at the stage where fold line 270 and curve lines 271 and 272 have been marked.

Having now described my invention, what I claim is:

1. A method of making a length of sheet material into an inflatable tube with a bend in it, which includes the steps of first overlapping and joining the longitudinal edges of a suitable sheet of material to form a flattened tube with a single longitudinal seam, marking on said flattened tube a fold line at the desired position of said bend, said marking including a peripheral boundary defining two areas, one on each side of said fold line, said two areas being intended to be pressed together to form said bend, folding the flattened tube so that said two areas contact each other, joining said areas together along substantially their entire peripheral boundary and then sealing the ends of the tube whereby surplus material is formed by said bend with some of the surplus material being inside the tube in the bend area and the remainder protruding outside the bend to form at least one visible projection in the finished tube.

2. A method according to claim 1, in which said fold line is substantially normal to the longitudinal direction of said flattened tube.

3. A method according to claim 1, in which a multiplicity of bends are formed and the ends of said tube are sealed by joining them together to form an endless tube.

4. A method according to claim 1, in which said flattened tube is turned inside out before applying the markings.

5. A method according to claim 1, in which said sheet material is a thermoplastic material and said two areas adjacent said fold line are joined together by welding.

6. A method according to claim 5, in which a barrier layer is positioned between the layers of said sheet material prior to said welding.

7. A method according to claim 5 or 6, in which the marking stage is carried out automatically by the positioning of welding apparatus relative to said sheet material.

8. A method according to claim 7, in which the marking, folding and welding steps are part of an automated process.

9. A method according to claim 1, in which said sheet material is of polymer-coated fabric and said two areas adjacent said fold line are joined to each other by means of adhesive-coated hinge tape.

10. A method according to claim 9, in which one arm of said hinge tape is adhered around the perimeter of the marked area on a first side of said fold line, the open side of said hinge tape lying away from said fold line, applying adhesive to the exposed face of the unadhered arm of said hinge tape and bending said fabric about said fold line until the perimeter of the marked area on the second side of said fold line contacts and is adhered to the adhesive-coated surface of said hinge tape on the said first side.

11. A method according to claim 1, in which said sheet material is formed into a multiplicity of integrally-formed, longitudinally-extending, flattened tubes and each of said tubes is marked, folded, joined and sealed to form an inflatable multiple tube with a bend in it.

12. A method of making an endless buoyancy tube for a liferaft, said tube being of polygonal plan form and having a bend between each adjacent pair of sides of the polygon, wherein the longitudinal edges of a suitable sheet of material are overlapped and joined to form a flattened tube, a fold line corresponding to each desired bend is marked on one surface of said flattened tube, two mirror image areas are marked, one on each side of each fold line, each pair of mirror image areas is pressed and joined together by folding about their respective fold line and the ends of the flattened tube are sealingly joined together to form said endless tube.

* * * * *

UNITED STATES PATENT AND TRADEMARK OFFICE

CERTIFICATE OF CORRECTION

PATENT NO. : 4,472,225

DATED : September 18, 1984

INVENTOR(S) : Malcolm SIMPSON

It is certified that error appears in the above-identified patent and that said Letters Patent is hereby corrected as shown below:

Under Related U.S. Application Data [63] on the first page (title page) should read:

--Nov. 30, 1979--

Signed and Sealed this

*Seventh* Day of *May 1985*

[SEAL]

*Attest:*

DONALD J. QUIGG

*Attesting Officer* *Acting Commissioner of Patents and Trademarks*